US005089767A

United States Patent [19]

Neidorff

[11] Patent Number: 5,089,767

[45] Date of Patent: Feb. 18, 1992

[54] CURRENT SENSOR AND LIMITER

[75] Inventor: Robert A. Neidorff, Bedford, N.H.

[73] Assignee: Unitrode Corporation, Billerica, Mass.

[21] Appl. No.: 506,352

[22] Filed: Apr. 9, 1990

[51] Int. Cl.[5] ..... G05F 3/20

[52] U.S. Cl. ..... 323/315; 323/299

[58] Field of Search ..... 323/277, 299, 313, 315, 323/303, 316, 349, 351

[56] References Cited

U.S. PATENT DOCUMENTS

| | | | |
|---|---|---|---|
| 3,846,696 | 11/1974 | Ahmed | 323/316 |
| 4,308,496 | 12/1981 | Nagano | 323/315 |
| 4,390,829 | 6/1983 | Jarrett | 323/313 |
| 4,533,970 | 8/1985 | Brown | 323/277 |
| 4,709,204 | 11/1987 | Hayakawa | 323/303 |
| 4,792,750 | 12/1988 | Yan | 323/315 |
| 4,831,323 | 5/1989 | Melbert | 323/315 |
| 4,851,759 | 7/1989 | Blauschild | 323/303 |
| 4,929,884 | 5/1990 | Bird et al. | 323/313 |

OTHER PUBLICATIONS

Colclaser et al., *Electronic Circuit Analysis*, ©1984 by John Wiley and Sons, Inc., pp. 66-68.

*Primary Examiner*—Steven L. Stephan
*Assistant Examiner*—Adolf Berhane
*Attorney, Agent, or Firm*—Weingarten, Schurgin, Gagnebin & Hayes

[57] ABSTRACT

A current sensor and limiter provides an output current having a value which is a sum of at least a portion of an input current and a reference current. The current sensor senses an input current which exceeds the reference current, and activates a current shunt which diverts from the input current, an amount of current which is equal to the amount of current by which the input current exceeds the reference current.

14 Claims, 1 Drawing Sheet

CURRENT SENSOR AND LIMITER

FIELD OF THE INVENTION

This invention relates to current monitoring circuits and more particularly, to circuits for sensing an input current with respect to a reference current and for limiting an output current with respect to the reference current.

BACKGROUND OF THE INVENTION

Many circuits exist for monitoring the output current of a given circuit and for limiting that output with respect to a predetermined threshold or reference. Prior circuits sense output current by providing a resistor in series with the current thereby Providing a voltage drop across the sense resistor. The voltage drop across the sense resistor is then compared to some predetermined voltage threshold and the input current is withdrawn or decreased when the voltage across the sense resistor exceeds the predetermined voltage threshold. Unfortunately, these circuits are only capable of monitoring a fixed or manually adjustable current level which is a function of the sense resistor. Such circuits necessarily restrict the dynamic range of the circuits and therefor greatly limit their flexibility and adaptability.

SUMMARY OF THE INVENTION

The current sensor and limiter according to the present invention includes means for receiving an input current as well as means for receiving a reference current. Additionally, there are means, responsive to the input current and to the reference current, for providing an output current which is a function of the input current. Further, current sensing means are responsive to the input current and the reference current, for sensing when the input current exceeds the reference current, and for diverting or subtracting from the input current an amount of current equal to the amount of current by which the input current exceeds the reference current. In accordance with the present invention, the current sensor and limiter circuit provides an accurate, reliable, current sensor and limiter with unlimited dynamic range potential, which is adjustable by simply varying the reference current and which is integrable with other circuits.

In the preferred embodiment, the means for providing an output current includes a current mirror circuit having at least one diode and at least one transistor. Additionally, the preferred embodiment includes a current sensing means comprising a transistor coupled between the input current and the reference current.

DESCRIPTION OF THE DRAWINGS

These and other features of the present invention will be more readily understood by reading the following detailed description, taken together with the drawings, wherein.

DETAILED DESCRIPTION OF THE INVENTION

Figure 1:
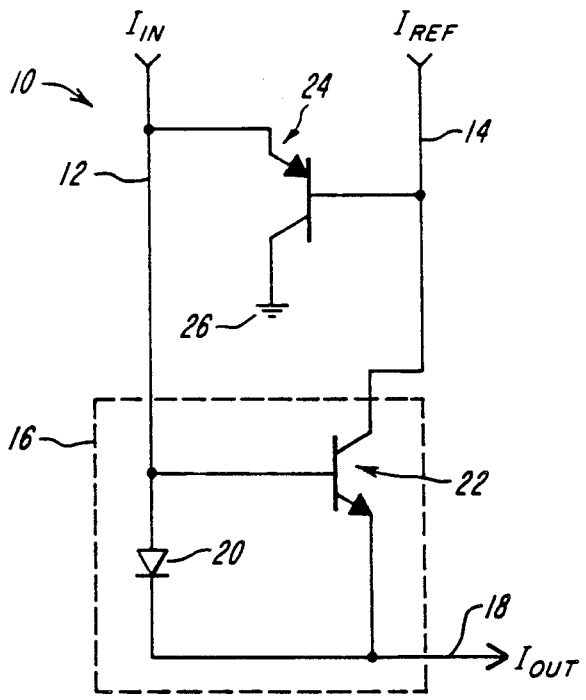
FIG. 1 is a schematic representation of one embodiment of the current sensor and limiter of the present invention.

FIG. 1 illustrates a first embodiment of the current sensor and limiter 10 according to the present invention, and includes signal path 12 for receiving an input current as well as signal path 14 for receiving a reference current. Circuitry 16 is responsive to the input and reference currents for providing an output current over signal path 18. Circuitry 16 includes diode 20 and NPN transistor 22 forming a standard current mirror.

Current sensing transistor 24 is responsive to the input current and the reference current for sensing an input current which exceeds the reference current, and for diverting to signal ground 26, an amount of input current which equals the amount of current by which the input current exceeds the reference current.

The operation of current sensor and limiter circuit 10 includes receiving an input current by means of signal path 12. A portion of the input current flows through diode 20, while a lesser amount of current flows through the base emitter junction of transistor 22, thereby energizing the transistor and causing an amount of current approximately equal to the input current to flow through the collector and emitter of transistor 22. The reference current received over signal path 14 establishes the maximum amount of current that the user wishes to provide to output circuit 16 from the input current. As long as the input current is less than or equal to the reference current, the output current over signal path 18 will be equal to two times the input current.

Once the input current exceeds the reference current, the collector-base junction of transistor 22 will begin to saturate and the collector emitter voltage across the transistor will decrease. This decrease in voltage will bias or energize sensing transistor 24. Since the amount of saturation of transistor 22 will be proportional to the amount of excess current flowing over the input signal path, sensing transistor 24 will be similarly proportionally biased and will divert an amount of input current approximately equal to the amount of current by which the input current exceeds the reference current. Under these conditions, the output current will equal two times the reference current.

Since there are no fixed component values that establish the sensing or reference circuit, the output current may be varied by simply changing the reference current. The circuit provides a current mirror with a self regulating negative feedback loop.

Figure 2:
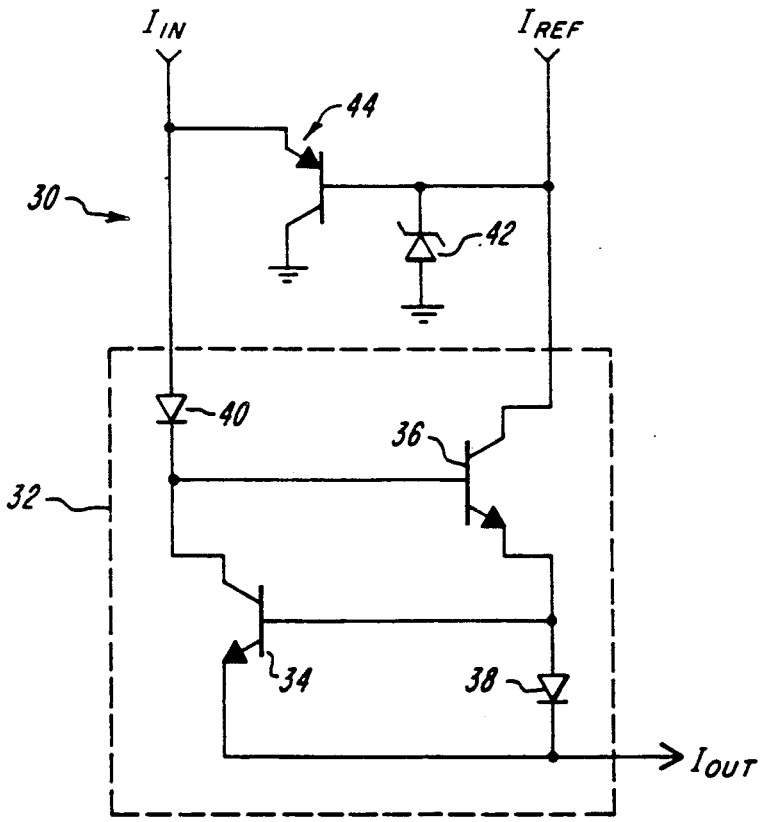
FIG. 2 is a schematic representation of an additional embodiment of a current sensor and limiter according to this invention.

In a second embodiment illustrated in FIG. 2, current sensor and limiter 30 includes a more accurate current mirror 32. In this embodiment, current output 32 includes transistors 34 and 36 which form an NPN Wilson current mirror providing greater accuracy of the current output. Diodes 38 and 40 are provided as level shifting or compensating diodes. Zener diode 42 provides over voltage protection to sensing transistor 44. The operation of this circuit embodiment is in accordance that described in relation to the circuit of FIG. 1.

The current sensor of the present invention can be constructed using ratioed transistors in place of diode 20 and transistor 22, FIG. 1, and transistor 34 and diode 38, FIG. 2. The ratioed transistors serve to limit output current when input current exceeds a preselected ratio of input current to reference current. The ratio can be greater than or less than 1 and is determined according to the transistor size ratio.

Modifications and substitutions to the present invention by one of ordinary skill in the art are considered to be within the scope of the present invention and the claims which follow.

I claim:

1. A circuit for sensing and limiting an input current as a function of a reference current, comprising:

a current mirror, responsive to said input current and to said reference current, for providing an output current which is the sum of said input current and said reference current; and an input current diverter, responsive to said current mirror, for sensing an input current level which exceeds said reference current, and for diverting from said input current, an amount of input current which generally equals the amount of current by which said input current exceeds said reference current.

2. The circuit of claim 1 wherein said input current is less than or equal to said reference current, and said output current equals two times said input current.

3. The circuit of claim 1 wherein said input current is greater than said reference current, and said output current equals two times said reference current.

4. The circuit of claim 1 wherein said current mirror provides an output current which is the sum of at least a portion of said input current and all of said reference current.

5. The circuit of claim 1 wherein said current mirror includes at least one diode and at least one transistor.

6. The circuit of claim 5 wherein said diode has an anode coupled to the input current, and a cathode coupled to said output current; and said transistor has a base coupled to the input current, a collector coupled to the means for receiving a reference current, and an emitter coupled to said output current.

7. The circuit of claim 6 wherein said transistor includes an NPN transistor.

8. The circuit of claim 1 wherein said input current diverter includes a transistor.

9. The circuit of claim 8 wherein said transistor includes a PNP transistor having a base coupled to said reference current;

an emitter coupled to said input current; and;

a collector coupled to signal ground.

10. The circuit of claim 1 wherein said current mirror includes a first and second transistors, and first and second diodes.

11. The circuit of claim 10 wherein said first diode includes an anode coupled to said input current, and a cathode coupled to the collector of said first transistor and the base of said second transistor;

said first transistor includes a base coupled to the anode of said second diode, and an emitter coupled to said output current;

said second transistor includes a collector coupled to said means for receiving a reference current, and an emitter coupled to the anode of said second diode; and said second diode includes a cathode coupled to said output current.

12. The circuit of claim 11 wherein said first and second transistors include NPN transistors.

13. The circuit of claim 1 further including a zener diode having a cathode coupled to said reference current, and an anode coupled to signal ground.

14. A circuit for sensing and limiting current comprising:

means for receiving an input current;

means for receiving a reference current;

a current mirror circuit, coupled to said means for receiving an input current and said means for receiving a reference current, for providing an output current which is the sum of at least a portion of said input current and all of said referenced current; and an input current diverter including a transistor coupled to said means for receiving an input current and said means for receiving a reference current, and responsive to said input current and to said reference current, for sensing an input current level which exceeds said reference current, and for diverting from said input current, an amount of current which generally equals the amount of current by which said input current exceeds said reference current.

* * * * *

UNITED STATES PATENT AND TRADEMARK OFFICE

CERTIFICATE OF CORRECTION

PATENT NO. : 5,089,767

DATED : February 18, 1992

INVENTOR(S) : Robert A. Neidorff

It is certified that error appears in the above-identified patent and that said Letters Patent is hereby corrected as shown below:

On the title page, item [54] and column 1, line 1, "CURRENT SENSOR AND LIMITER" should read --CURRENT SENSOR AND LIMITER UTILIZING CURRENT MIRROR--.

Column 1, line 17, "thereby Providing" should read --thereby providing--.

Signed and Sealed this

Second Day of November, 1993

Bruce Lehman

*Attest:*

BRUCE LEHMAN

*Attesting Officer*

*Commissioner of Patents and Trademarks*